United States Patent [19]

Goldberg

[11] Patent Number: 5,039,324

[45] Date of Patent: Aug. 13, 1991

[54] SEALABLE COLLAR VACUUM CLEANER BAG

[75] Inventor: Howard Goldberg, Newburgh, N.Y.

[73] Assignee: Mastercraft Industries, Inc., Newburgh, N.Y.

[21] Appl. No.: 566,858

[22] Filed: Aug. 10, 1990

Related U.S. Application Data

[63] Continuation of Ser. No. 329,360, Mar. 27, 1989, abandoned.

[51] Int. Cl.[5] ..... B01D 46/42

[52] U.S. Cl. ..... 55/367; 55/374

[58] Field of Search ..... 55/367, 374–377

[56] References Cited

U.S. PATENT DOCUMENTS

| | | | |
|---|---|---|---|
| 2,596,806 | 5/1952 | Borkowski | 55/367 |
| 3,108,736 | 10/1963 | Anderson et al. | 55/367 |
| 3,432,998 | 3/1969 | Downey | 55/367 |
| 3,726,067 | 4/1973 | Fesco | 55/367 |
| 3,751,881 | 8/1973 | Hughes | 55/367 |
| 3,803,815 | 4/1974 | Anderson et al. | 55/367 |
| 3,929,437 | 12/1975 | Gaudry | 55/367 |
| 3,933,541 | 1/1976 | Johansson | 55/367 |

*Primary Examiner*—Richard L. Chiesa
*Attorney, Agent, or Firm*—Lilling and Lilling

[57] ABSTRACT

Air leakage passageways formed by an elongated sealing finger deflected through a sealable collar of a vacuum cleaner bag are substantially eliminated by the use of straddling tabs or an additonal elastic membrane across the collar opening which assure a total seal between the collar opening and the vacuum cleaner inlet fitting when the latter extends through the opening.

8 Claims, 7 Drawing Sheets

FIG.10
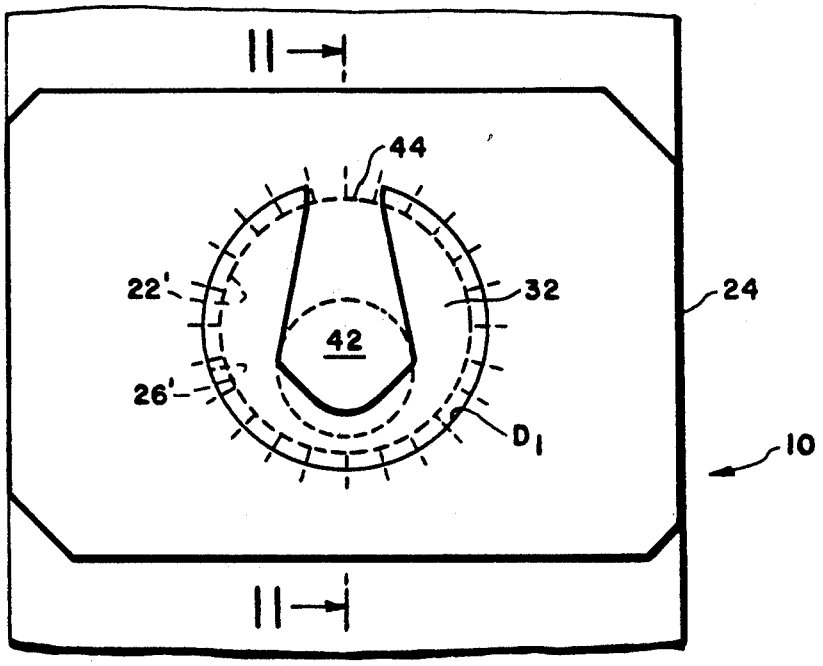
FIG.9
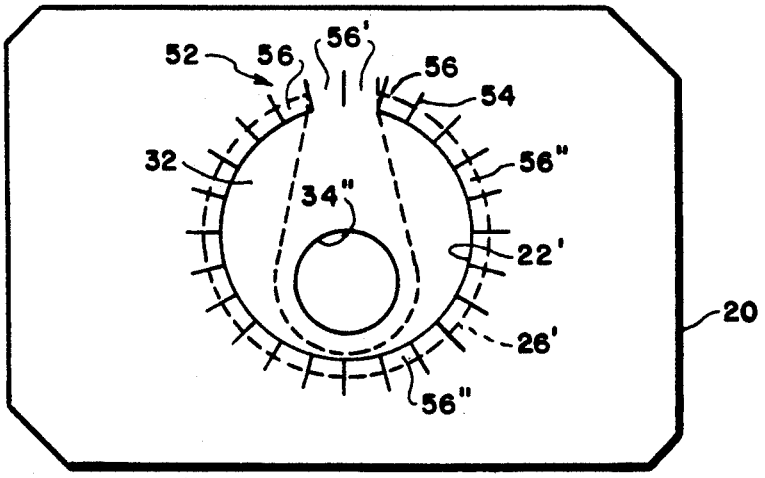
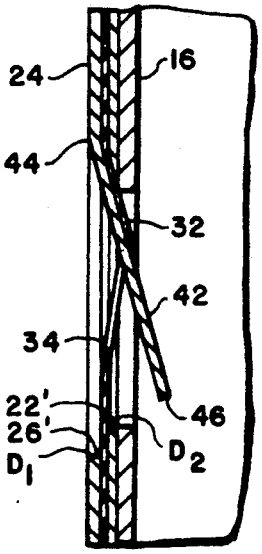
FIG.11

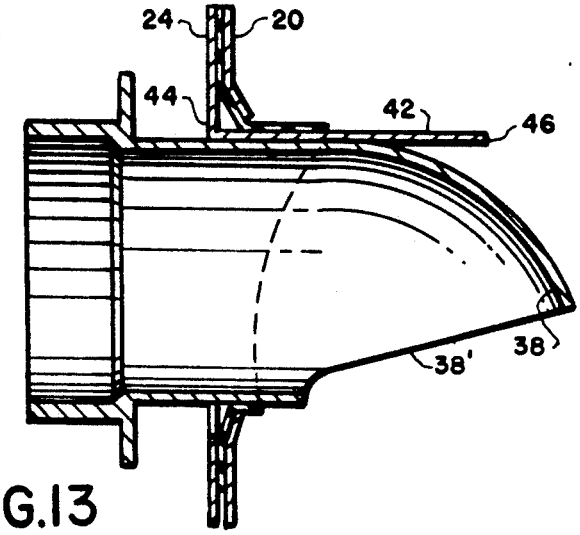
FIG.13
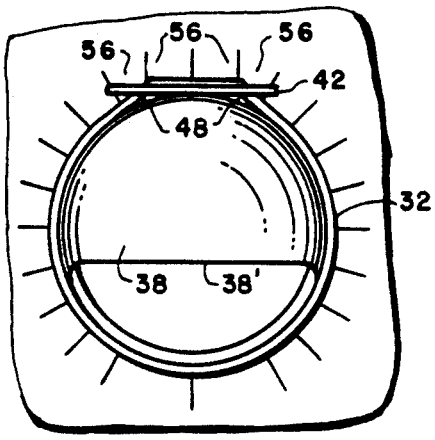
FIG.12
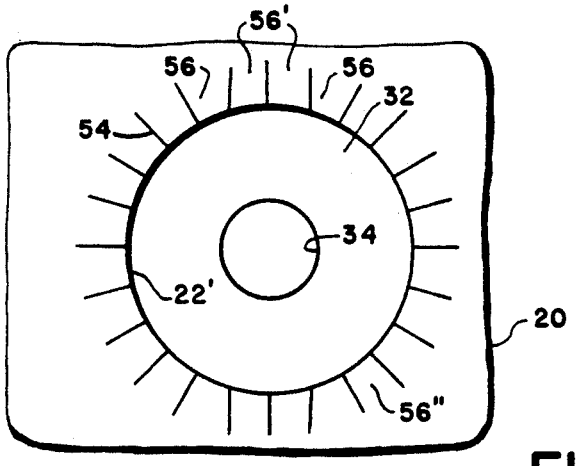
FIG.14
FIG.15
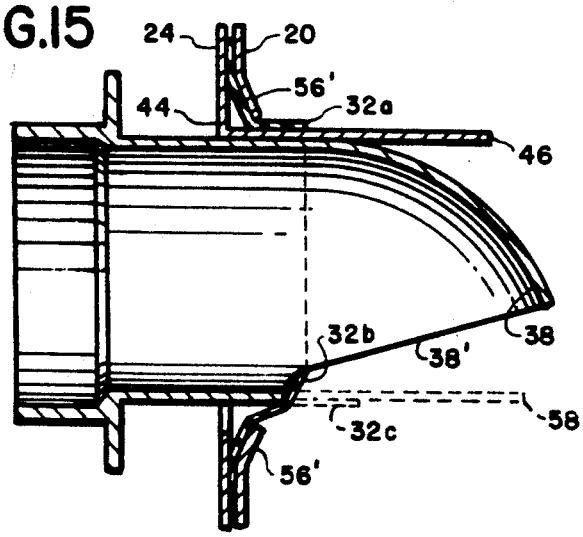
FIG.16
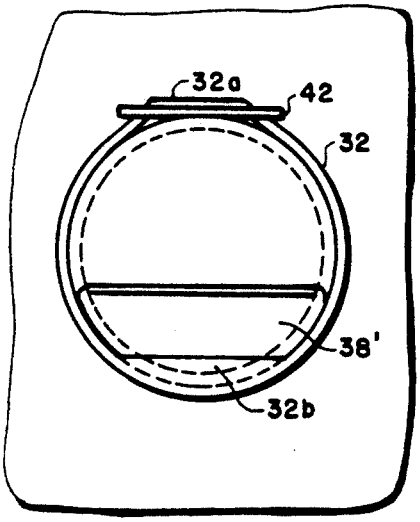

FIG.17
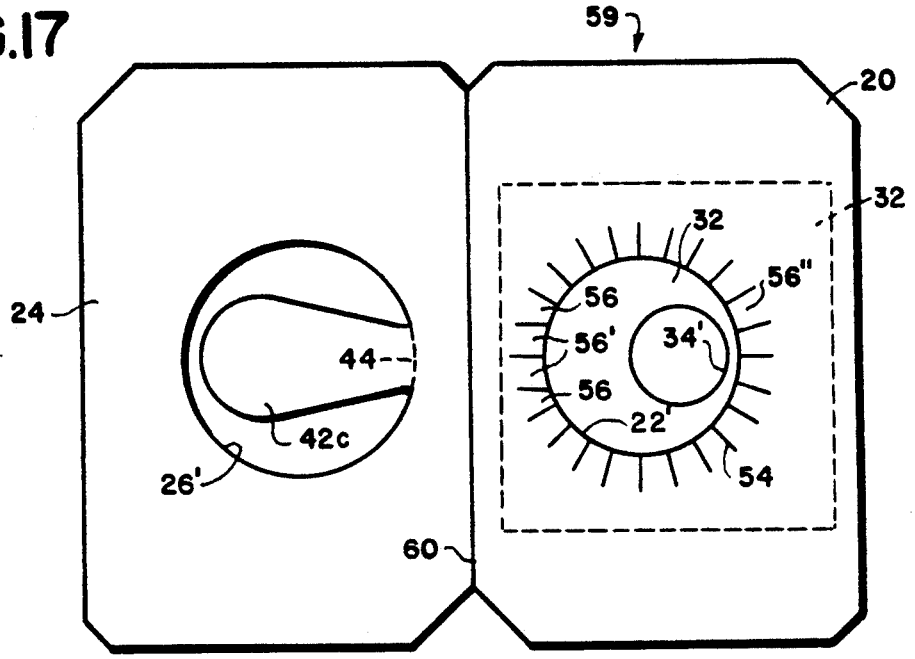
FIG.18
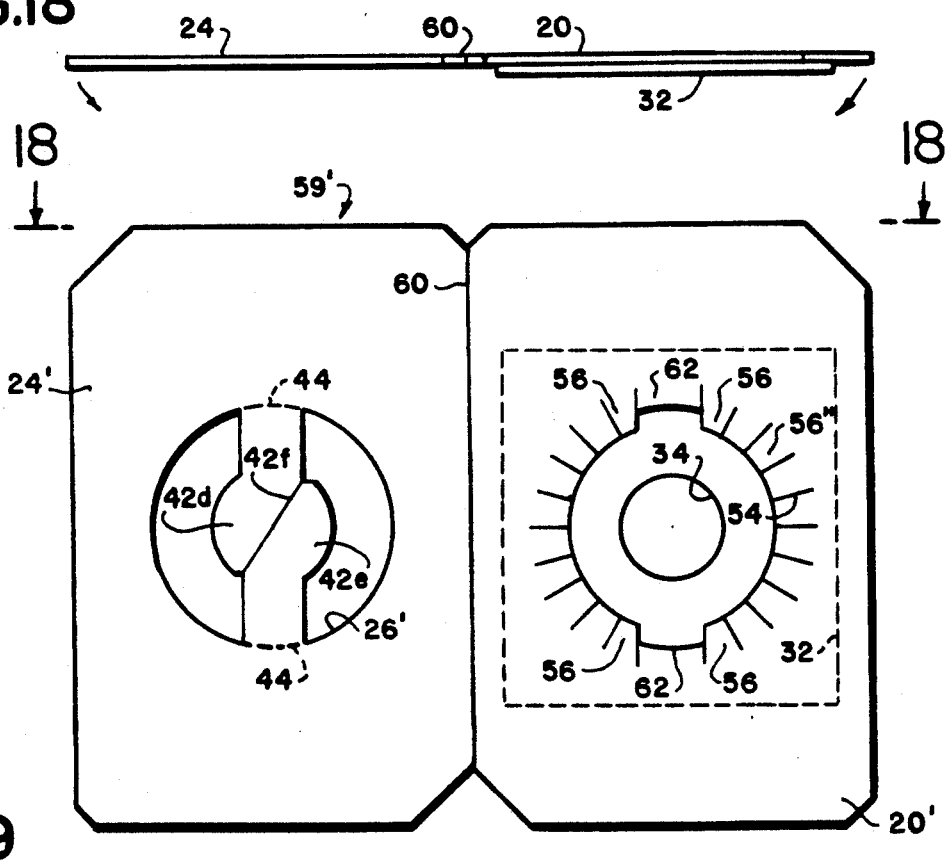
FIG.19

SEALABLE COLLAR VACUUM CLEANER BAG

This is a continuation of copending application Ser. No. 329,360 filed on Mar. 27, 1989, now abandoned.

BACKGROUND OF THE INVENTION

1. Field of the Invention

This invention generally relates to vacuum cleaner bags, and more specifically to a sealable collar for use with vacuum cleaner bags which substantially eliminates reverse flow of leakage air and debris from the vacuum cleaner bag into the vacuum cleaner.

2. Description of the Prior Art

It is desirable that filter systems be made spill proof so that contents will not escape from the bags when they are removed for replacement and it is desirable that the hole in the inlet seal be as small as possible and still be able to be attached to the inlet of a vacuum cleaner inlet fitting without difficulty or inconvenience.

A problem currently encountered when using a "tongue" type self seal of a single rubber or elastic seal style filter bag is that the collar is mounted onto an inlet fitting of a vacuum cleaner and there is an air passage condition that exists because the seal's hole does not seat with continuous contact on the surface of the inlet fitting. This causes the possibility of a dirty air stream being sucked back into the vacuum cleaner chamber. This presents a serious problem when vacuuming hazardous or other fine materials.

Although numerous vacuum cleaner bag constructions have been proposed, none have substantially eliminated the air leakage passageways which result when the "tongue" self seal extends through a single rubber or elastic seal in the bag.

SUMMARY OF THE INVENTION

It is, accordingly, an object of the present invention to provide a sealable collar of a vacuum cleaner bag which eliminates the problem above-described, by substantially eliminating reverse flow of leakage air and debris from the vacuum cleaner bag into the vacuum cleaner.

It is another object of the present invention to provide a sealable collar of the type under discussion which is simple in construction and economical and inexpensive to manufacture.

It is still another object of the present invention to provide a sealable collar as in the aforementioned objects which provides a substantially continuous seal between the elastic seal of the membrane provided in the collar of the bag and the inlet fitting of the vacuum cleaner, notwithstanding the deflection and deformation of the membrane by the self-sealing tongue which extends through the opening in the membrane.

It is yet another object of the present invention to provide a sealable collar construction which can be easily adapted for use with angled or straight inlet fittings to thereby accommodate all vacuum cleaner inlet fitting designs.

In order to achieve the above objects, as well as others which will become apparent hereafter, a sealable collar of a vacuum cleaner bag having a bag inlet opening in a wall of the bag for receiving an inlet fitting of a vacuum cleaner and a flow of air and debris comprises a generally flat mounting member for mounting the bag on the inlet fitting. Said mounting member is formed with a collar opening arranged in registry with said bag inlet opening when said mounting member is attached to the wall of the bag. Said bag inlet and collar openings together define an air passage having an area dimensioned to receive the inlet fitting with little clearance. A generally elongate sealing finger at least partially extends across said air passage area and is attached at one end thereof and free at the other end thereof to be pivotally movable out of the plane of said mounting member about said one end. A flexible and stretchable membrane extends across said air passage area and is provided with a membrane opening, air leakage passageways being formed between said membrane and the inlet fitting when the inlet fitting is inserted through said membrane opening and said air passage area to deflect said elongate sealing finger through said membrane opening. Sealing means are provided for substantially sealing said air leakage passageways when the inlet fitting is inserted through said air passage area of the collar to thereby substantially eliminate reverse flow of leakage air and debris from the vacuum cleaner. bag into the vacuum cleaner through said air leakage passageways.

BRIEF DESCRIPTION OF THE DRAWINGS

The above-described and additional object and advantages of the invention will become more apparent from the following detailed description of the preferred embodiments thereof, with reference to the accompanying drawings, wherein:

FIG. 9 is a rear elevational view of one presently preferred embodiment of a sealable collar in accordance with the present invention, showing a plurality of a radial tabs formed on an inner sheet of cardboard material attached to the wall of the vacuum cleaner bag;

FIG. 10 is a front elevational view of the sealable collar shown in FIG. 9, showing the associated sheet of cardboard material attached to the sheet shown in FIG. 9, and showing the arrangement of the sealing tongue or finger following insertion through the membrane opening and also showing the relative diameters of the openings in the two attached sheets of material;

FIG. 11 is a cross-sectional view of the collar shown in FIG. 10, taken along line 11—11;

FIG. 12 is a rear elevational view of the sealing collar shown in FIGS. 9–11, showing an inlet fitting inserted through the collar opening and illustrating the straddling tabs for substantially eliminating the leakage air passageways;

FIG. 13 is a side elevational view of the sealable collar shown in FIG. 12;

FIG. 14 is a rear elevational view similar to that shown in FIG. 9, but showing a centered hole in the membrane;

FIG. 15 is similar to FIG. 13, but showing the blockage resulting from the use of a centered hole in the membrane as shown in FIG. 14 in conjunction with an angled inlet fitting 38, and also showing in phantom outline why a straight inlet fitting of uniform diameter which does not deflect the air flow and debris in the bag avoids this problem;

FIG. 16 is a rear elevational view similar to FIG. 12, but showing the blockage of the air flow resulting from the use of a centered hole in the membrane with an angled inlet fitting as shown in FIG. 15;

FIG. 17 is a top plan view of a blank which can be used to form a sealable collar shown in FIG. 9-11;

FIG. 18 is an end elevational view of the blank shown in FIG. 17, shown before folding about the center fold or score line to create the sealable collar;

FIG. 19 is similar to FIG. 17, but showing an alternate or modified form of the blank 58 resulting in a modified construction of the sealable collar;

DESCRIPTION OF THE PREFERRED EMBODIMENTS

Figure 1:
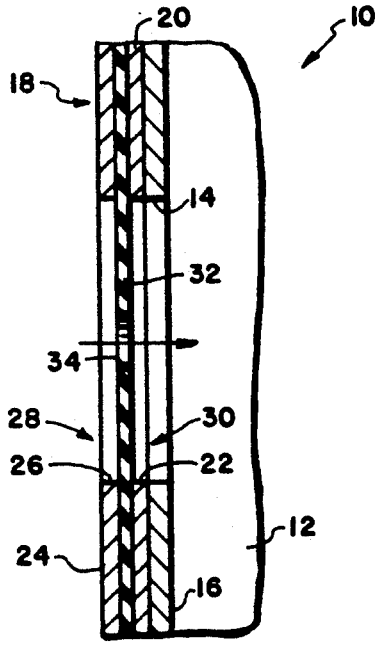
FIG.1 PRIOR ART
FIG. 1 is a cross-section of a prior art collar of a vacuum cleaner bag, showing the basic elements of such a collar construction.
Figure 2:
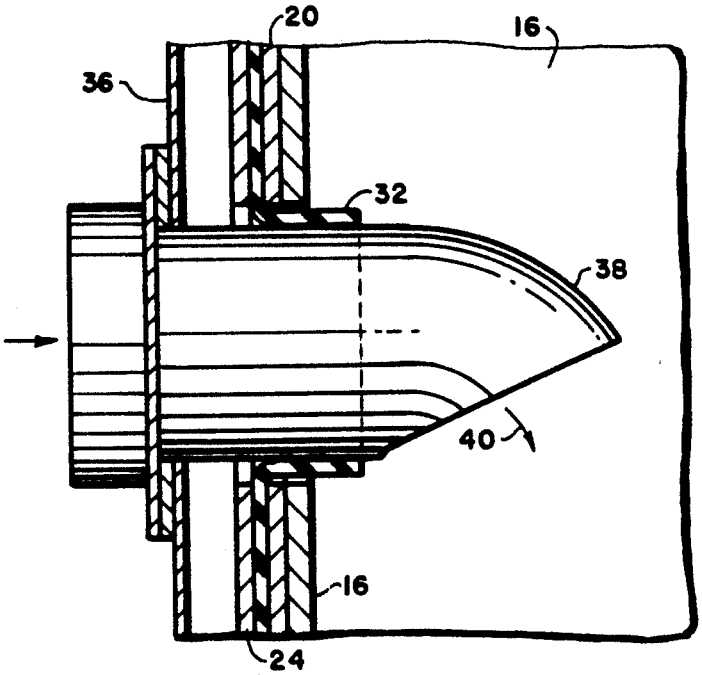
FIG.2 PRIOR ART
FIG. 2 is similar to FIG. 1, but showing an inlet fitting extended through the collar opening as would be the case during actual use of the bag.
Figure 3:
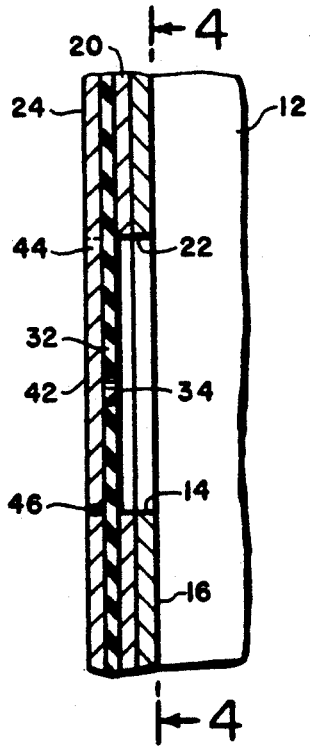
FIG.3 PRIOR ART
FIG. 3 is a cross-sectional view of another prior art construction of a collar of a vacuum cleaner bag similar to the one shown in FIGS. 1 and 2, but also utilizing a self-sealing finger or tongue for closing the opening in the elastic membrane after use to prevent spillage of debris through the membrane opening.

Referring now specifically to the figures, in which identical or similar parts are designated by the same reference numerals throughout, FIGS. 1 and 2 show prior art constructions of a collar of a vacuum cleaner bag which illustrate the problem which is sought to be solved by the present invention.

The sealable collar is generally designated the reference numeral 10.

The collar 10 is attached to a vacuum cleaner bag 12 which has a bag inlet opening 14 formed in a bag wall 16. The bag inlet opening 14 is dimensioned to receive an inlet fitting of a vacuum cleaner.

The sealable collar includes a generally flat mounting member 18 for mounting the bag 12 on the vacuum cleaner inlet fitting. As will become evident from the description that follows, the specific construction of the mounting member 18 is not critical, and numerous constructions may be utilized. According to one prior art or known construction, the mounting member 18 includes a first sheet of flat material 20, such as cardboard, provided with a first circular opening 22, and a second sheet of flat material such as cardboard, 24 provided with a second circular opening 26, the openings 14, 22 and 26 being concentric with each other as shown and dimensioned to receive an inlet fitting which includes a cylindrical outer surface of substantially uniform circular cross-section. The aforementioned openings together define a collar opening 28 which forms an air passage 30 through which air and debris flows into the vacuum cleaner bag.

It is known in the vacuum cleaner bag art to utilize a flexible and stretchable membrane 32, such as a thin sheet of rubber, which extends across the air passage area 30 and is provided with a membrane opening 34. Referring to FIG. 2, the vacuum cleaner typically includes a canister can 36 which supports an air inlet fitting 38 for directing a flow of air and debris 40 into the vacuum cleaner bag 16.

Figure 4:
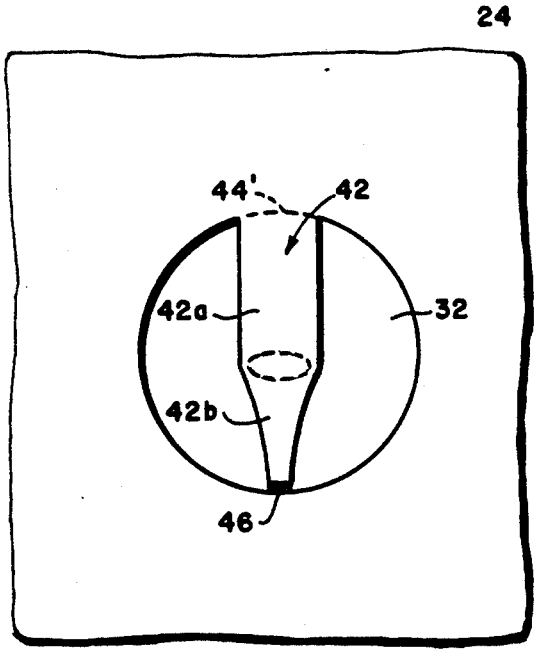
FIG.4 PRIOR ART
FIG. 4 is a front elevational view of the collar shown in FIG. 3, showing the self-sealing tongue or finger in its initial position prior to use of the vacuum cleaner bag.
Figure 5:
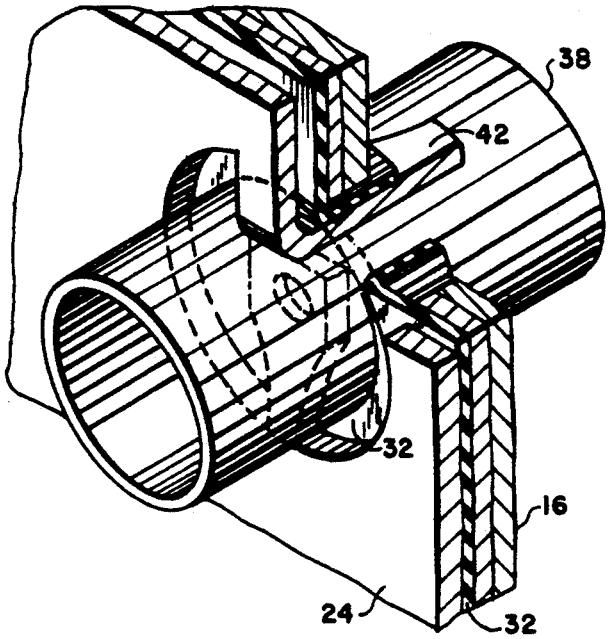
FIG.5 PRIOR ART
FIG. 5 is a perspective view, showing the deflection and/or deformation of the various elements shown in FIGS. 3 and 4 upon insertion of the inlet fitting through the collar opening.
Figure 6:
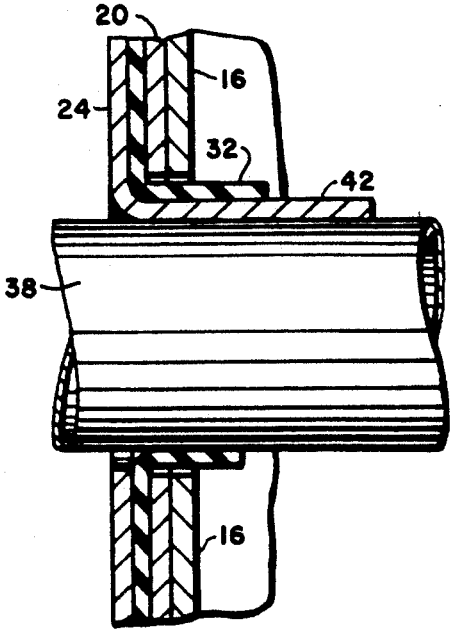
FIG.6 PRIOR ART
FIG. 6 is a side elevational view, in cross-section, of the arrangement shown in FIG. 5.
Figure 7:
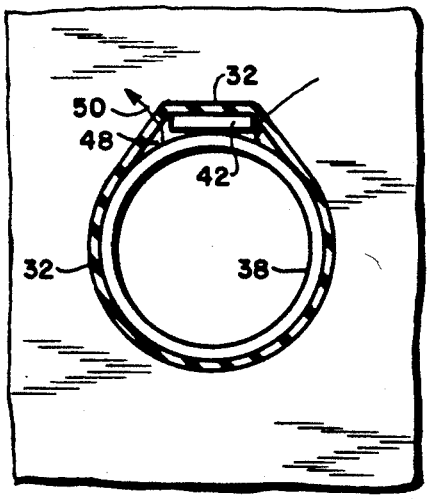
FIG.7 PRIOR ART
FIG. 7 is a rear elevational view of the arrangement shown in FIG. 6, showing the resulting air leakage passageways formed between the elastic membrane and the inlet fitting due to the action of the self-sealing finger or tongue.
Figure 8:
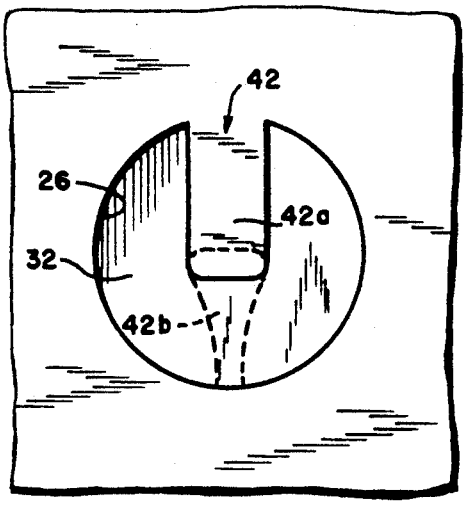
FIG.8 PRIOR ART
FIG. 8 is similar to FIG. 4, but showing the position of the tongue extending through the membrane opening after being forced therethrough by the inlet fitting thereby closing the membrane opening and preventing spillage of debris.

It is also well known in the vacuum cleaner bag art to utilize a general elongate sealing finger or tongue 42 which at least partially extends across the air passage area 30 and is attached at one end 44 thereof and free at the other end 46 thereof to be pivotally movable about the attached end 44 out of the plane of the mounting member 18. The self-sealing finger of tongue 42 is normally disposed upstream of the vacuum cleaner bag collar whereby insertion of the inlet fitting 38 through the collar opening 28 forces the sealing finger or tongue 42 to be urged through the membrane opening 34 following the deformation or stretching of the flexible membrane 32. When the tongue 42 has been forced through the membrane opening 34, it remains extended through the opening even after the inlet fitting 38 is withdrawn, whereby the tongue 42 closes or blocks the membrane opening 34 and prevents undesired spillage of debris through the opening. Referring to FIG. 4, the deflection of the self-sealing finger or tongue 42 may be facilitated by providing a score line 44' at the attached end of the tongue.

Referring to FIGS. 5-8, the problem which the present invention solves is illustrated. Once the inlet fitting 38 is inserted through the collar opening 28, the self-sealing finger or tongue 42 stretches the elastic membrane 32 and creates spaces or air leakage passageways 48 which permit the undesired flow 50 of leakage air and debris from the vacuum cleaner bag into the vacuum cleaner. While the sealing tongue 42 may block the membrane opening 34 (FIG. 8) after the inlet fitting is removed, the undesired air leakage passageways 48 exist during such time that the inlet fitting 38 remains inserted through the collar opening 28. In accordance with the present invention, sealing means are provided for substantially eliminating such undesired leakage passageways.

Referring to FIG. 9, one preferred embodiment of sealing means is illustrated and generally designated by the reference numeral 52 for substantially sealing the air leakage passageways 48 when the inlet fitting 38 is inserted through the air passage area 30 of the collar 10 to thereby substantially eliminate reverse flow of leakage air and debris from the vacuum cleaner bag 16 into the vacuum cleaner. In the embodiment shown in FIGS. 9 and 10, the sealing means 52 comprises the use of a plurality of radial slits 54 arranged about the periphery 22' of the rear flat sheet or member 20. The radial slits 54 are arranged to form at least two radials straddling tabs 56, each straddling tab 56 being arranged on one side of the attached end 44 of the sealing finger or tongue 42, and extending radially inwardly beyond the region occupied by the inlet fitting 38 prior to insertion thereof. In this manner, insertion of the inlet fitting 38 through the collar opening 28 causes the sealing finger 42 to be deflected through the membrane opening 34 into the bag 16 and the straddling tabs 56 to be deflected while radially inwardly urging the membrane 32 against the inlet fitting 38 on each side of the sealing finger 42 to thereby substantially eliminate the air leakage passageways or spaces 48 (FIG. 12).

In the embodiment disclosed, the diameter $D_1$ of the circular opening or periphery 26' is greater than the outer diameter of the inlet fitting 38 to facilitate insertion of the inlet fitting through the collar opening 8, while the diameter $D_2$ of the circular opening or periphery 22' is smaller than the external diameter of the inlet fitting 38 to provide a press-fit relationship between the radial tabs 56'' which will deflect upon insertion of the inlet fitting 38, and generally at least partially revert to their original positions once the inlet fitting 38 is removed.

Thus while the straddling tabs 56 are aligned to each side of the sealing tongue 42, to eliminate the air leakage spaces or passageways 48, the remaining radial tabs 56'' all abut against and urge the flexible membrane against the inlet fitting to assure good contact and to minimize leakage.

Referring to FIGS. 11, the sealing tongue or finger 42 is shown extended through the membrane aperture 34 thereby being in a position to block such membrane aperture following withdrawal of the inlet fitting due to the tendency of the sealing finger to return to its original undeflected position.

As best shown in FIG. 9, the membrane opening 34' is shown to be offset in relation to the centers of the openings 22' and 26'. Such offset in the membrane opening 34' is useful when used with inlet fittings 38 of the angled type shown, for example, in FIGS. 12, 13, 15 and 16 which deflects air and debris upon entry into the bag. By reducing the radial width of the rubber in the lower region of the membrane, with the arrangement shown in FIGS. 12, 13, the membrane does not cover any part of the opening 38' of the inlet fitting 38, as would be the case with a centered membrane hole 34, as, for example, shown in FIGS. 15 and 16. Thus, while the upper portion **32*a* of the membrane abuts against the sealing tongue 46, the lower portion 32*b* of the membrane could result in blockage of air flow and debris with the angle-type inlet fitting. Referring to FIG. 15, there is shown in dashed outline a modified construction 58 of the inlet fitting which would cause air and debris to enter the bag undeflected. With this construction, the membrane material 32*c* abuts against the modified inlet fitting surface of the extension 58 allowing free or unhampered air and debris to flow into the bag 16**.

Referring to FIGS. 17–19, a blank 59 is shown which can be used to form the sealable collar 10 in accordance with the invention. The first or bottom and second or top sheets 20 and 24 are shown joined at a score or fold line 60 which permits the panels or sheets to be folded into abutment against and suitably attached to each other as suggested in the prior figures, with the membrane 32 disposed or sandwiched in between. The self-sealing finger or tongue **42*c* is formed part of and is initially in the plane of the sheet 24. Any suitable attachment means may be used familiar to those skitted in the art, such as adhesive. By forming a blank 59 as shown, alignment of the straddling tabs 56 with the side edges of the finger or tongue 42 is insured. Thus, in one operation, the finger or tongue 42 and all of the radial slits 54 and resulting radial tabs 56, 56' and 56'' can be accurately formed in a single die cut operation. No additional alignment procedures need be taken, and maximum elimination of the air leakage passageways or spaces 48 is assured. In accordance with the presently preferred embodiment, the self-sealing finger or tongue 42*c* is in the shape of a tear drop, as shown, to facilitate penetration into the membrane opening and blockage of the opening following withdrawal of the inlet fitting. FIG. 18 illustrates the blank 59** prior to folding of the blank in the directions of the arrows to produce the sealable collar.

In FIG. 19, a modified design is shown for the self-sealing finger or tongue. Here, two sealing fingers **42*d* and 42*e* are provided which extend radially inwardly from diametrically opposite sides of the collar opening 26' and meet at the center thereof at a split 42*f*. Here, the means for sealing must provide for sealing the air leakage passageways formed by both of the sealing fingers 42*d* and 42*e*. Thus, a pair of straddling tabs 56 is provided at diametrically opposite sides of the opening in the sheet 20' which urge the membrane 32 to abut against the inlet fitting at both ends 44 of connection between the fingers or tongues 42*d* and 42*e* and the sheet 24'. The radial tabs 56' shown, for example, in FIG. 17 are eliminated and replaced by a notch 62 in the region where the membrane abuts against the sealing finger or tongue. The remaining radial tabs 56'' continue to be used and serve the same function as in the previously described embodiment shown in FIG. 17**.

Figure 20:
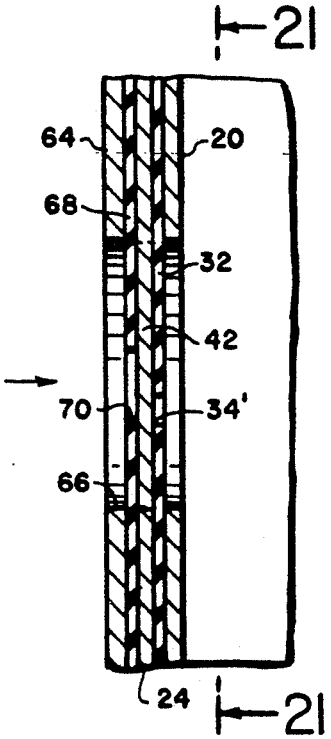
FIG. 20 is a side elevational view, in cross section, of an alternate embodiment of the present invention, utilizing a second membrane in lieu of a straddling tabs for elimination of air leakage passageways upon the insertion of the inlet fitting through the collar opening and deflection of the sealing tongue through the opening of the primary sealing membrane.
Figure 21:
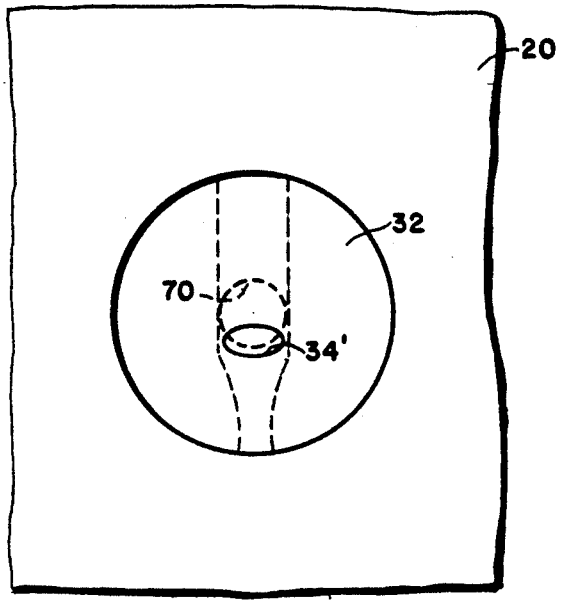
FIG. 21 is a rear elevational view of the collar construction shown in FIG. 20, as viewed along line 21—21.
Figure 26:
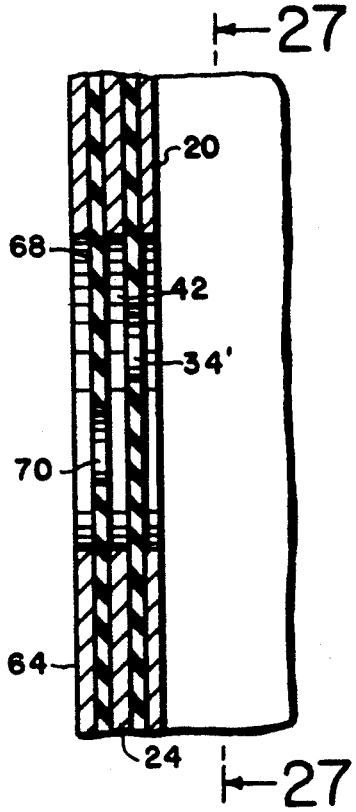
FIG. 26 is similar to FIG. 20, but showing two openings in the primary and secondary membranes which are offset from each other.
Figure 27:
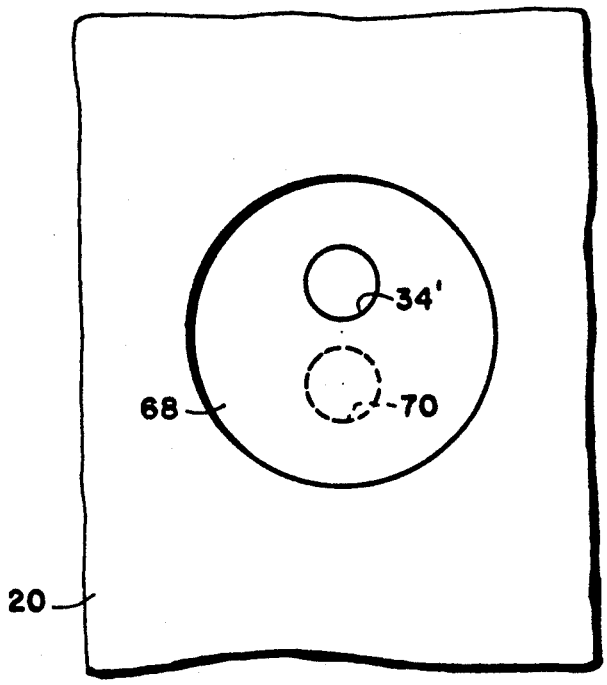
FIG. 27 is a rear elevational view of the sealable collar shown in FIG. 26, as viewed along line 27—27.
Figure 24:
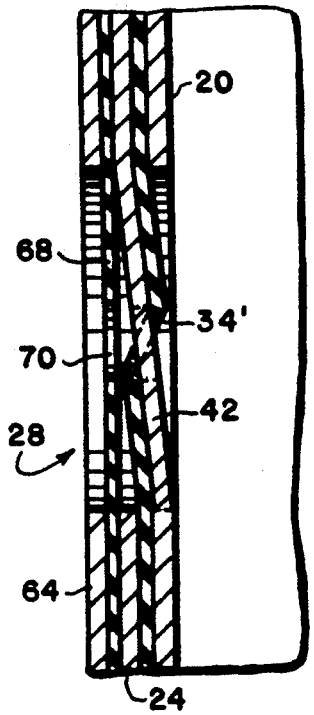
FIG. 24 is a side elevational view, in cross-section, of the sealable collar as shown in FIG. 20, shown after withdrawal of the inlet fitting shown in FIGS. 22 and 23.
Figure 25:
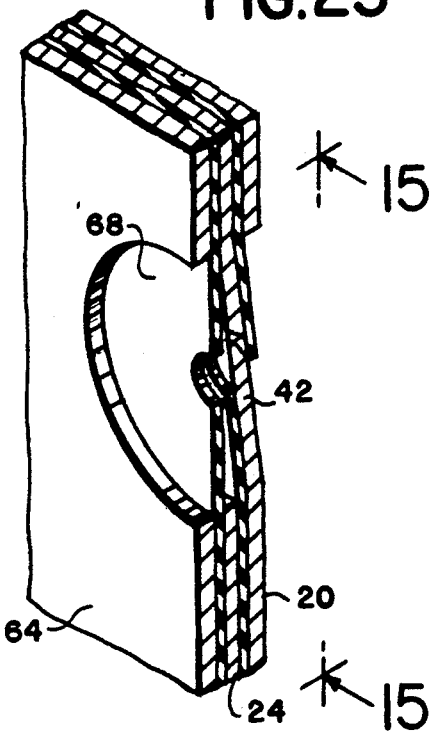
FIG. 25 is a perspective view, in cross-section, showing the arrangement of elements shown in FIG. 24 after the retraction of the inlet fitting from the collar opening.

Referring to FIGS. 20–23, a further embodiment of the invention is shown wherein the mounting collar or member includes an additional third sheet 64 of flat material attached to the sheets 20 and 24 previously described. The first or primary membrane 32 is secured between the first and second sheets of flat material 20, 24, as previously described. However, the means for sealing the spaces or air leakage passageways 48 is in the form of a secondary membrane 68 attached between the second sheet 24 and the third sheet 64 as shown. Here, the sealing finger or tongue 42 is arranged on the second sheet 24 between the first and second membranes 32 and 68 which are provided with first and second membrane openings 34' and 70, respectively, which are arranged and dimensioned to receive the inlet fitting 38. The sealing finger or tongue 42 is arranged to be deflected through the first membrane opening 34' when the inlet fitting 38 is inserted therethrough. The first and second inlet membrane openings 34' and 70 may be concentrically aligned, as shown in FIG. 20, or may be offset with respect to each other as suggested in FIGS. 26 and 27.

Figure 22:
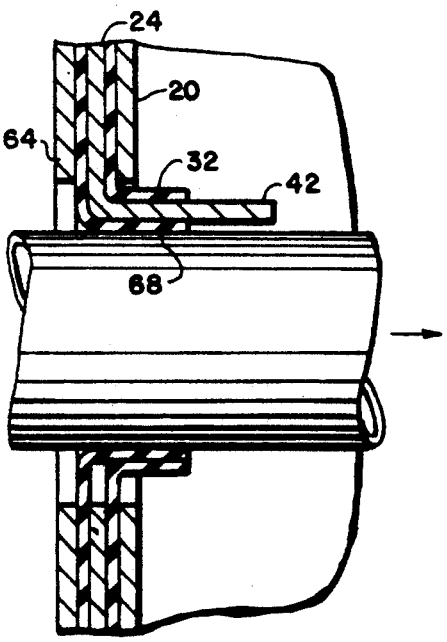
FIG. 22 is similar to FIG. 20, but showing the rearrangement of elements upon the insertion of the inlet fitting through the collar opening.
Figure 23:
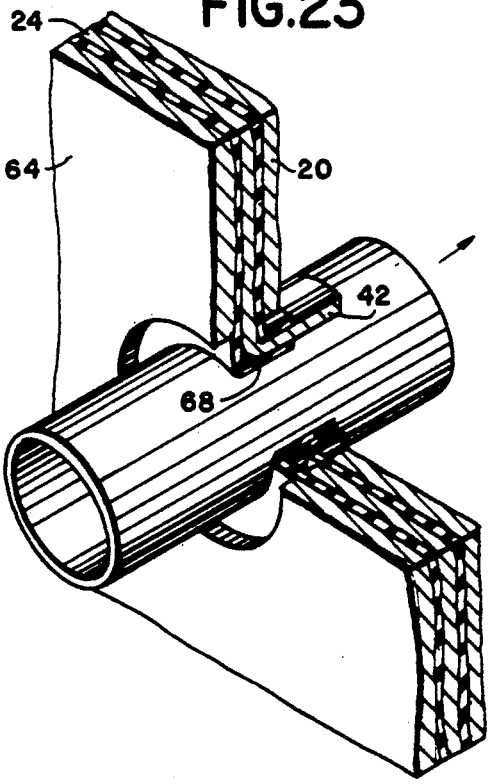
FIG. 23 is a perspective view of the sealable collar as shown in FIG. 22 during use.

It will be appreciated that in the embodiments shown in FIGS. 20–27, radial straddling tabs 56 are not provided and there are no elements on the panels or sheets which resiliently urge the primary membrane 32 against the inlet fitting to eliminate the spaces or air leakage passageways 48. Instead, the second membrane 68 substantially eliminates such air leakage passageways by forming a separate second and independent seal between the sealing finger or tongue 42 and the inlet fitting as shown in FIGS. 22 and 23. In both instances, the undesired spaces or air leakage passageways are eliminated to thereby substantially eliminate reverse flow of leakage air and debris from the vacuum cleaner bag 16 into the vacuum cleaner.

While the invention has been described above with respect to specific embodiments, numerous alterations of the structure herein disclosed will be apparent to those ordinarily skilled in the art. The illustrated embodiments of the invention which are given for the purpose of illustration only and are not to be construed as a limitation of the invention as set forth in the claims.

What is claimed is:

1. A sealable collar of a vacuum cleaner bag having a bag inlet opening in a wall of the bag for receiving an inlet fitting of a vacuum cleaner and the flow of air and debris, the collar comprising a generally flat mounting member for mounting the bag on the inlet fitting, said mounting member being formed with a collar opening arranged in registry with said bag inlet opening and said mounting member being attached to the wall of the bag, said bag inlet and collar openings together defining an air passage having an area dimensioned to receive the inlet fitting with little clearance, said mounting member comprising inner and outer sheets of flat material attached to each other, said collar opening being formed of consecutive inner and outer circular openings formed respectively in said inner and outer sheets; a generally elongate sealing finger at least partially extending across said air passage area and attached at one end thereof to said mounting member in the plane of said outer sheet of material, said sealing finger being free at the outer end thereof to be movable out of the plane of said mounting member about said one end; a flexible and stretchable membrane attached to said mounting member and secured between said inner and outer sheets of material, said membrane extending across said air passage area and being provided with a membrane opening, air leakage passageways being formed between said membrane and the inlet fitting when the inlet fitting is inserted through said membrane opening and said air passage area to deflect said elongated sealing finger through said collar and membrane openings; and sealing means attached to said mourning member for substantially sealing said air leakage passageways when the inlet fitting is inserted through said air passage area of the collar to thereby substantially eliminate reverse flow of leakage air and debris from the vacuum cleaner bag into the vacuum cleaner through said air leakage passageways, said sealing means comprising at least two radial straddling tabs formed on the periphery of said first opening in said first sheet, one straddling tab being arranged on and adjacent to each side of said sealing finger and extending radially inwardly beyond the region occupied by the inlet fitting prior to insertion hereof, whereby insertion of the inlet fitting through said collar opening causes said sealing finger to be deflected through said member opening into the bag and said straddling tabs to be deflected thereby urging said membrane against the inlet fitting on each side of said sealing finger to thereby substantially eliminate said air leakage passageways.

2. A collar as defined in claim 1, wherein said sheets of flat material are made of cardboard.

3. A collar as defined in claim 1, wherein the inlet fitting includes cylindrical outer surface of uniform circular cross-section and said collar opening is formed of consecutive inner and outer circular openings formed respectively in said inner and outer sheets.

4. A collar as defined in claim 3, wherein the diameter of said outer circular opening is greater than the diameter of the inlet fitting to facilitate insertion of the inlet fitting through said collar opening, and the diameter of said inner circular opening being smaller than the diameter of the inlet fitting to provide a press-fit relationship between the inner sheet and the inlet fitting.

5. A collar as defined in claim 1 further comprising a plurality of radial tabs about the periphery of said inner opening, said tabs extending radially inwardly beyond the region occupied by the inlet fitting prior to inserting thereof, whereby insertion of the inlet fitting through said collar opening causes said radial tabs to be deflected and abut against said membrane to assure a seal between said membrane and the inlet fitting about said cylindrical outer surface thereof.

6. A collar as defined in claim 1, for an inlet fitting which is angled to deflect air and debris upon entry into the bag wherein said membrane opening is offset in relating to the center of said collar openings to prevent overlap of said membrane with the opening in the inlet fitting and resulting blockage of flow of air and debris into the bags.

7. A collar as defined in claim 1, wherein said sealing finger has a teardrop shape.

8. A collar as defined in claim 1, wherein two sealing fingers are provided which extend radially inwardly from diametrically opposite sides of said collar opening and meet at the center thereof, said sealing means sealing said air leakage passageways formed by both said sealing finger when the inlet opening deflects said two sealing fingers through said membrane opening.

* * * * *